United States Patent [19]

Nightingale

[11] 4,357,895

[45] Nov. 9, 1982

[54] TENNIS AID

[76] Inventor: Gerry Nightingale, 6 Glencara St., Avondale Heights, 3034, Victoria, Australia

[21] Appl. No.: 158,569

[22] Filed: Jun. 11, 1980

[30] Foreign Application Priority Data

Jun. 11, 1979 [AU] Australia ..... PD9143

[51] Int. Cl.[3] ..... A63B 71/06

[52] U.S. Cl. ..... 116/225; 273/DIG. 26

[58] Field of Search ..... 116/307, 225, 323, 321, 116/222; 273/DIG. 26

[56] References Cited

U.S. PATENT DOCUMENTS 4,132,187 1/1979 Moebius ..... 116/225

4,185,583 1/1980 Stamm ..... 116/225

*Primary Examiner*—Robert I. Smith

*Attorney, Agent, or Firm*—Scully, Scott, Murphy & Presser

[57] ABSTRACT

The present invention relates to a tennis scoring aid comprising a board, first and second markers movable along, respectively, first and second paths, positions of said board adjacent said paths bearing markings, successively, with respect to said paths, representing the tennis scoring points "love", "15", "30", "40" and "game" whereby scores of two players or two teams of players may be indicated by moving one of said markers which is to be considered allocated to one player or team, and by moving the other of said markers, which is to be considered to be allocated to the other player or team, to the appropriate one of said positions; and further including a mechanism such that, when both of said markers are at positions corresponding to the score "40", to interpose a position representing the scoring point "advantage" between the "40" position, which "40" position will thereafter represent the scoring point "deuce", and "game".

11 Claims, 9 Drawing Figures

TENNIS AID

Figure 1:
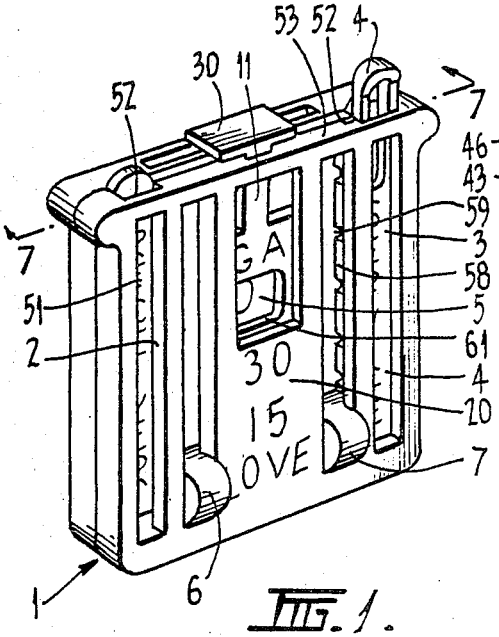

This invention relates to a tennis aid. In a particular aspect it relates to a tennis scoring aid.

The present invention provides a tennis scoring aid comprising a board, first and second markers movable along, respectively, first and second paths, positions of said board adjacent said paths bearing markings, successively, with respect to said paths, representing the tennis scoring points "love", "15", "30", "40" and "game" whereby scores of two players or two teams of players may be indicated by moving one of said markers which is to be considered allocated to one player or team, and by moving the other of said markers, which is to be considered to be allocated to the other player or team, to the appropriate one of said positions; and further including a mechanism such that, when both of said markers are at positions corresponding to the score "40", to interpose a position representing the scoring point "advantage" between the "40" position, which "40" position will thereafter represent the scoring point "deuce", and "game".

The aid preferably also includes linkage means interconnecting said markers such that when one or the other of said markers is moved from both of said markers representing "deuce" to representing "advantage" said other or said one is moved to represent "30" and, when said other or said one is moved to represent "deuce" after having previously been moved to represent "30" by said linkage, said one or said other is moved from representing "advantage" to represent "deuce".

Preferably said mechanism, on both of said markers coming to the positions corresponding to "4038 causes the marking representing "40" to be obscured by a marking representing "deuce".

Preferably said mechanism includes a silider carrying markings representing "game" and "deuce" and which, in a first position of that slider, is oriented such that the board reads or represents, successively, "love", "15", "30", "40", "game" and which, in a second position of that slider, is oriented such that "deuce" obscures "40", "game" has moved to disclose a marking reading or representing "advantage" and such that the board reads or represents, successively, "love", "15", "30", "deuce", "advantage", "game".

Preferably said mechanism includes two latches which hold said slider in said first position; which latches being freed by both said markers moving to the positions representing "40" but wherein at least one latch remains in the latched position if one of said markers is at a position representing "love", "15" or "30".

Said linkage means is preferably such as to cause movement of one or other of said markers from "advantage" towards "love" in consequence of said other or said one of said markers being moved from "deuce" towards "game".

A reset mechanism is preferably provided for returning said slider to said first position at the end of a game of tennis.

Said linkage means preferably includes a cable which, when taut, will cause movement of one of said markers in the opposite direction to movement of the other of said markers.

Adjacent each of said markers there may be an indicator with a marking reading or representing "receiver" and a movable indicator with a marking reading or representing "server" may be provided for obscuring a selected one of the indicators with a marking reading or representing "receiver".

The aid may have means for carrying slips, cards or other indicators bearing names or other representers of the actual players or teams. A storage compartment may be provided for those slips, cards or other indicators.

The aid preferably has additional markers which can be moved to indicate the number of games won by each player or teams of players. Further, the aid preferably has additional markers which can be moved to indicate the number of sets won by each player or teams of players.

Figure 2:
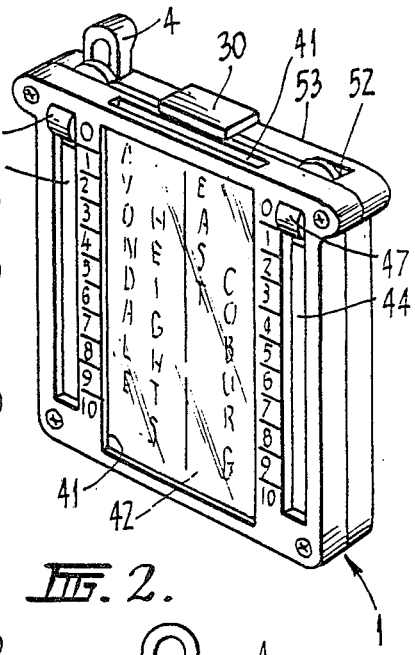
Figure 3:
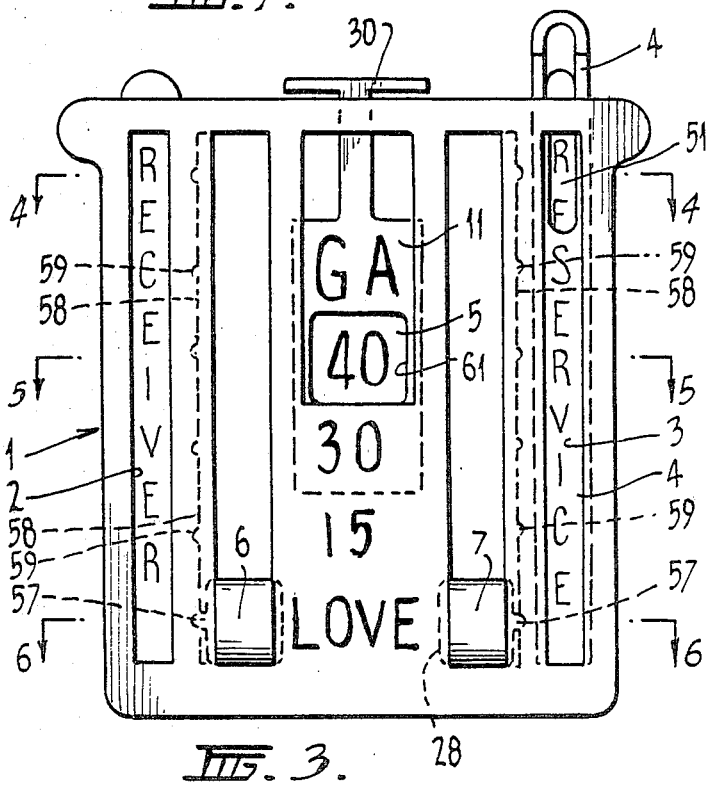
Figure 4:
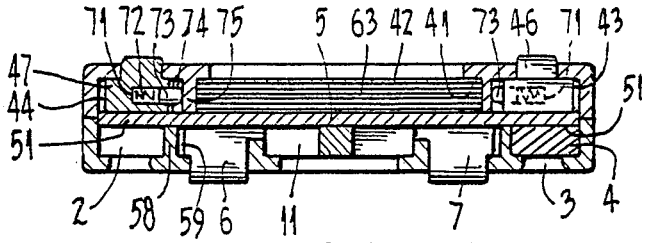
Figure 5:
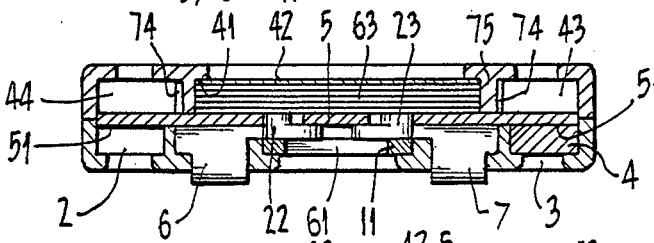
Figure 6:
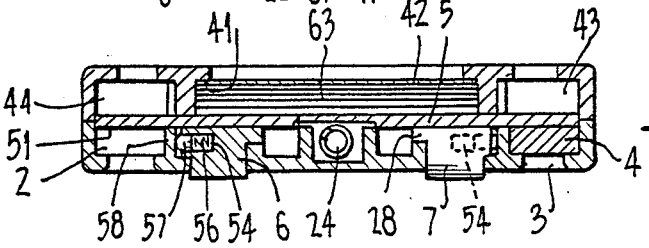
Figure 8:
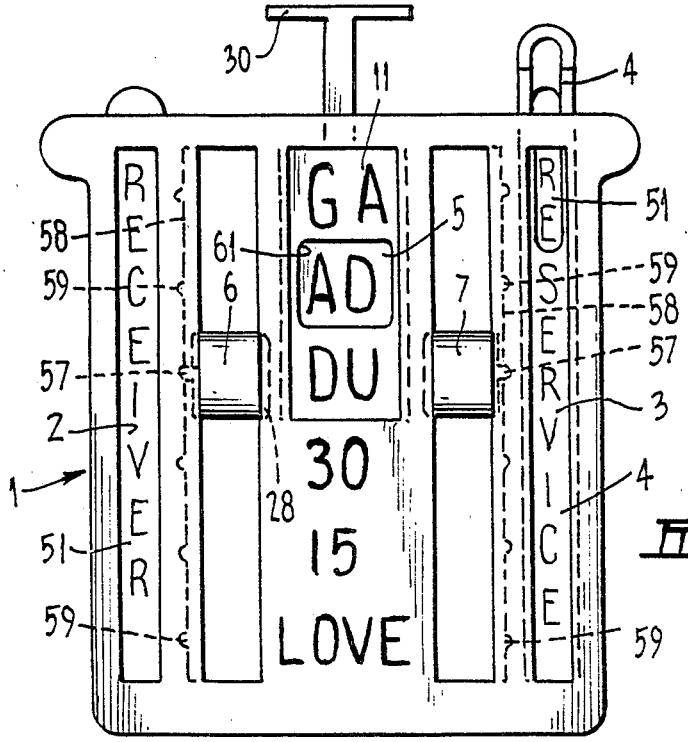
Figure 7:
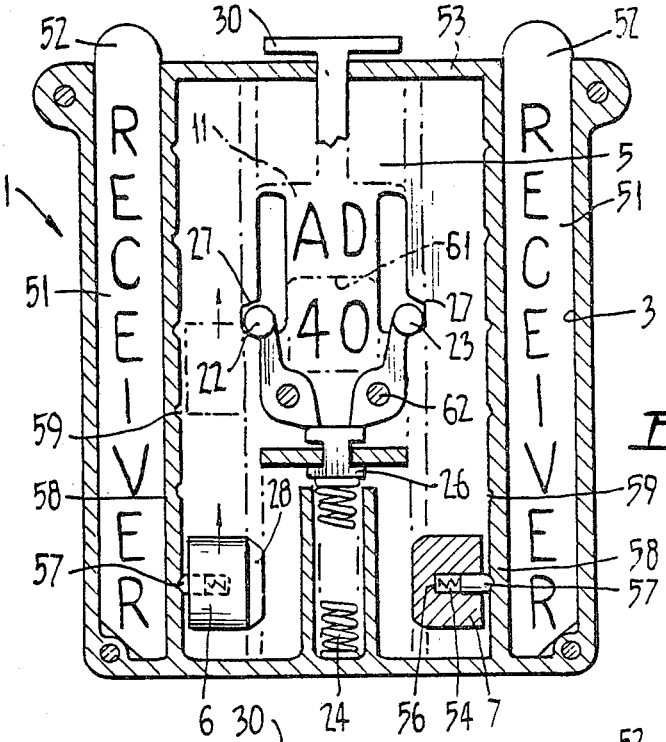
Figure 9:
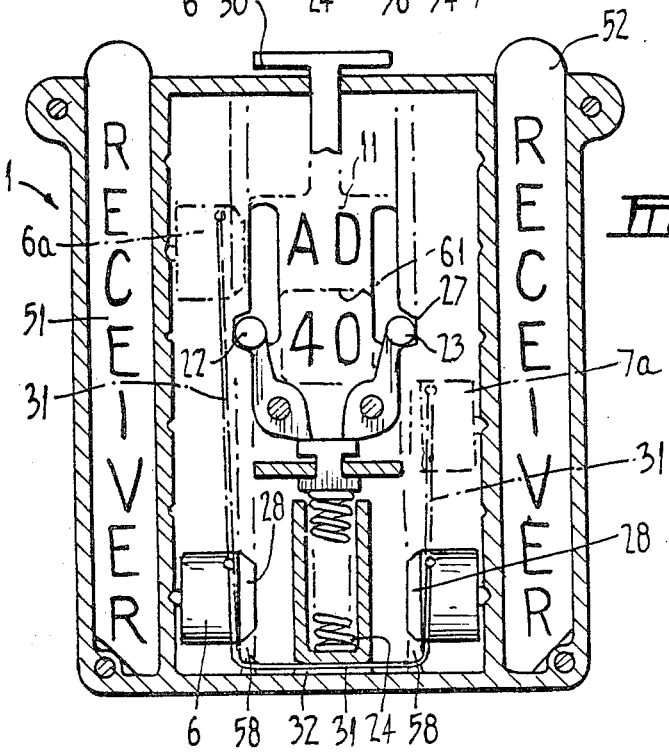

A specific construction of a tennis scoring aid in accordance with this invention will now be described with the aid of the accompanying drawings in which:

FIG. 1 is a front perspective view of the aid with certain parts thereof in one position, FIG. 2 is a rear perspective view of the aid, FIG. 3 is a front elevational view of the aid with said parts in said one position, FIG. 4 is a cross-section on line 4—4 in FIG. 3, FIG. 5 is a cross-section on line 5—5 in FIG. 3, FIG. 6 is a cross-section on line 6—6 in FIG. 3, FIG. 7 is a cross-section on line 7—7 in FIG. 1, FIG. 8 is a view similar to FIG. 3 but with said parts in another position, and FIG. 9 is a view similar to FIG. 7 but shows a modification.

The tennis scoring aid shown in the drawings comprises a front portion seen in FIG. 1 for displaying tennis "game" scores and a rear portion seen in FIG. 2 for displaying tennis "set" scores.

The game portion will now be described.

The aid comprises a body 1 having slots 2 and 3. On the bottom 51 of those slots is written the word "RECEIVER". A slider 4 is provided for insertion into the selected slot through holes 52 in end wall 53 and that slider bears the word "SERVER". By selecting the left hand slot 2 for the slider 4 if the server in a game of tennis is on an umpire's left or the right hand slot 3 for the slider 4 if the server is on the umpire's right a tennis umpire will at all times be reminded of which player is the server and which player is the receiver.

Marked on the body 1 are "LOVE", "15" and "30". Additionally, marked on a fixed panel 5 within the body 1 is "40". Additionally, marked on a movable slider 11 within the body is "GA" (representing "game"). Thus, as shown in FIG. 1 the body reads "LOVE, 15, 30, 40, GA".

Two markers 6 and 7 are provided and are slidable within the body and are slid, as appropriate, to mark the scores of the server and receiver. FIG. 1 shows the score love-love. The markers 6 and 7 are provided with bores 54, springs 56 and detents 57 which, under the influence of the springs 56, can engage in notches 59 in walls 58 to retain the markers 6 and 7 in selected positions.

If, from the FIG. 1 score showing of love-love the game progressed to a situation of 30–40, the marker 6 would be adjacent "40" and the marker "7" would be adjacent "30". If, from the score of 30–40 the receiver were to win another point the marker 6 would be advanced to "GA", the game would be over, both markers would be returned to "LOVE", the slider 4 would be moved to the slot 2, the win of a game would be recorded on the rear portion (to be described later) and another game could commence.

However if, from the score of 30–40 the server were to win a point the marker 7 would be advanced to "40" so that both markers 6 and 7 were at "40" and this is the point in tennis known as "deuce". Further, after "deuce" the scoring proceeds differently as compared to if deuce is not reached.

The slider 11 has a slot or window 61 through which "40" on panel 5 was visible therein and also has "DU" (representing "deuce") marked thereon. As shown in FIG. 1, "DU" is hidden by front face 20.

Secured to the slider 11 on pins 62 are two pawls 22 and 23 whose lower ends are acted upon by a spring (24) loaded body 26 to bias the upper ends of the pawls outwardly to engage with abutments 27 at one end of slots in the panel 5 to thereby restrict the slider 11 against upward movement within the body 1. It should be noted that only about half the thickness of the pawls 22 and 23 are engaged by the abutments 27.

The markers 6 and 7 have projections 28 and when one of the markers comes to the "40" position the projection 28 acts on the respective pawl and disengages it from the respective abutment 27. This is shown on the left in FIG. 7.

However, if only one of markers 6 and 7 is at the "40" position only one of pawls 22 and 23 is released and hence the slider 11 is not free to move. Thus, the marker which is at the "40" position can be moved to the "GA" (game) position if the point scoring is appropriate.

When both of markers 6 and 7 are at the "40" position both pawls 22 and 23 are freed from the abutments 27 and the slider moves upwardly under the bias of the spring 24 which biases the slider 11 as well as the body 26 and this results in the marking "GA" moving upward, the slot or window 61 moves upwardly and reveals the marking "AD" which stands for "advantage" on the panel 5, the marking "DU" moves upwardly and overlies the marking "40" on the panel 5 and a reset button 30 attached to the slider 11 projects from the top of the body.

The aid is now in a condition as shown in FIG. 8 in which it reads "LOVE, 15, 30, DU, AD, GA" and is ready to indicate tennis scores subsequent to "deuce".

The aid will now be considered from the point of view of what might happen in a tennis match.

From a game position where the score is 40–30 assume that the receiver wins a point. His marker, 6 as shown in FIG. 8, will be advanced to "40", the pawl 23 has previously been released by the marker 7, will cause the pawl 22 to release and the slider 11 to slide to reveal "DU", mark "40", reveal "AD" and shift "GA" as described above and both markers will be adjacent "DU" representing deuce.

From that game position where the score is deuce assume that the receiver wins another point. His marker, 6 as shown in FIG. 8, will be advanced to "AD" representing "advantage receiver" and marker 7 will remain at "DU". If at this stage of the game the server wins a point the marker (6) of the receiver will be returned to "DU" by the scorer. The above and the alternative "advantage server" may repeat several times but eventually one player will, after having been at "advantage", win a point so that his marker can be advanced to "GA" representing "game". The game is then over, both markers 6 and 7 would be returned to "LOVE", the slider 4 would be moved to the slot 2, the reset button 30 would be depressed to return the slider to the FIG. 3 position against the spring 24 which acting through body 26 will cause the pawls 22 and 23 to engage with the abutments 27, the win of a game would be recorded on the rear portion and another game could commence with the aid reset to present as shown in FIG. 3.

The rear portion will now be described. On the rear of the aid is a slot 41 similar to slots 2 and 3 but larger.

Cards may be provided for insertion into those slots on which players or teams' names may be written. For instance, a card 42 reading "Avondale Heights" and "East Coburg" representing two teams is shown. Such cards may be stored as a stack 63.

Also on the rear portion are slots 43 and 44 in which freely slidable markers 46 and 47 are located. There is no interconnection between the markers 46 and 47. The rear portion bears numerals 0 and 1 to 10.

The markers 46 and 47 have bores 71, springs 72 and detents 73 which can engage with notches 74 in walls 75 so as to hold the markers 46 and 47 in selected position.

To use the rear portion the markers 46 and 47 are moved to indicate the number of games won by each player. Games won in excess of 10 will be rare but in some such situations one might start again at "1" to represent "11" and etcetera.

Thus, there is provided a tennis scoring aid which will be of use to umpires and others which can keep a proper account of the strange and unusual scoring system used in tennis.

In a modification of the aid of FIGS. 1–8 which is shown in FIG. 9 the markers 6 and 7 are connected by a cable 31 which runs about ends of walls 58 and in a groove 32. That cable 31 would have had slack in it when the markers 6 and 7 were below the "DU" position but at that position the cable 31 is taut.

The modified aid will now be considered from the point of view of what might happen in a tennis match.

From a game position where the score is "deuce" assume that the receiver wins a point. His marker, say, 6, will be advanced to position *6a* adjacent to "AD" representing "advantage receiver" and because of the cable 31 the marker 7 will move to the "30" position as shown at *7a*. If, at this stage of the game the server wins a point his marker (7 as shown in FIG. 2) will be advanced to "DU" and because of the cable 31 the marker 6 will be returned to "DU". The above may repeat several times but eventually one player will, after having been at "advantage", win a point so that his marker can be advanced to "GA". The game is then over, both markers 6 and 7 would be returned to "LOVE", the slider 4 would be moved to the slot 2, the reset button 30 would be depressed to return the slider 11 to the FIG. 3 position against the spring 24 which, acting through body 26 will cause the pawls 22 and 23 to engage with the abutments 27, the win of a game would be recorded on the rear portion and another game could commence with the aid presenting similar to FIG. 3.

Modifications and adaptations may be made to the above described without departing from the spirit and scope of this invention which includes every novel feature and combination of features disclosed herein.

The claims form part of the disclosure of this specification.

I claim:

1. A tennis scoring aid comprising a board having a front face and a rear face, said front face having two transversely extending paths formed therein, said paths each having a scoring marker disposed therein, said scoring markers having protuberances extending therefrom and being slideably movable within said paths whereby a given score of a team or player can be indicated by the position of the marker within the path; and a scoring means having at least one pawl extending therefrom said means positioned between said paths and actuated by the engage- of said pawls with the protruberances of said scoring markers.

2. A tennis scoring aid as defined in claim 1, said scoring means comprising a spring actuated plunger mechanism, said mechanism being actuated upon the movement of said scoring markers to a predetermined position of said front face.

3. A tennis scoring aid as defined in claims 1 or 2, said plunger mechanism having markers representing "deuce", advantage, and "game" which are only individually visible upon movement of said scoring means.

4. A tennis scoring aid as defined in claim 3, said spring actuated mechanism comprising a slider having game markings thereon, said slider having two pawls fastened thereto, each pawl extending laterally from said slider and spring loaded to be retained in the extended position; said scoring markers having projections thereon which upon the joint sliding thereof said markers will engage the pawls and dispose them inwardly; said slider having a spring disposed therebelow whereby upon inward movement of the pawl the spring forces the slider in an upward direction.

5. A tennis scoring aid as defined in claim 4, said scoring means comprising a reset means for returning said slider to a downwardly disposed position.

6. A tennis scoring aid as defined in claim 5, said front face comprising two transversely extending slots each having a bottom upon which the word receiver is written thereon, and a movable indicator having the word server written thereon, said indicator extending above said board and is slidably received within a slot so as to substantially cover said bottom of said slot.

7. A tennis scoring aid as defined in claim 1, said rear face having a player indicator receiving means so as to identify the players and the score of each.

8. A tennis scoring aid as defined in claim 4, said scoring markers having a linkage means which interconnect said markers, said means being actuated by the movement of the markers past a predetermined position.

9. A tennis scoring aid as defined in claim 8, said predetermined position comprising positioning both markers to a position representing a tie, or deuce, at 40; upon further moving of either marker in an upward direction said linkage means causes a corresponding downward movement to the other scoring marker.

10. A tennis scoring aid as defined in claim 8, said linkage means comprising a cable fastened to the scoring markers and disposed in said path and disposed below said spring positioned below said slider.

11. A tennis scoring aid as defined in claims 1 or 2 or 4, said rear face having slots with markers slidably positioned therein, said slots having numerical markings formed onto said rear face in close proximity thereto, whereby said markers can be slidably moved to indicate the amount of games won by either player or team.

* * * * *